United States Patent [19]

Goodin

[11] 4,152,812

[45] May 8, 1979

[54] COTTON CLEANING ATTACHMENT FOR COTTON SCRAPER

[76] Inventor: Dolph L. Goodin, 1923-2nd Ave. #12, Yuma, Ariz. 85364

[21] Appl. No.: 816,908

[22] Filed: Jul. 18, 1977

[51] Int. Cl.[2] ..... D01B 1/00

[52] U.S. Cl. ..... 19/203; 19/35

[58] Field of Search ..... 19/200, 202, 203, 204, 19/205, 35–38, 55, 58; 56/28, 30, 35, 36; 209/78, 108

[56] References Cited

U.S. PATENT DOCUMENTS

| | | | |
|---|---|---|---|
| 1,658,731 | 2/1928 | Mitchell | 19/35 |
| 2,739,353 | 3/1956 | Mitchell et al. | 19/35 X |
| 3,070,942 | 1/1963 | Mitchell et al. | 19/36 X |
| 3,425,097 | 2/1969 | Rood, Jr. et al. | 19/203 |
| 3,467,991 | 9/1969 | Gray | 19/203 |
| 3,512,237 | 5/1970 | Elder et al. | 19/202 X |
| 3,769,660 | 11/1973 | Schuette, Jr. | 19/202 |

FOREIGN PATENT DOCUMENTS

| | | | |
|---|---|---|---|
| 197331 | 11/1967 | U.S.S.R. | 56/28 |

*Primary Examiner*—Dorsey Newton

*Attorney, Agent, or Firm*—Clarence A. O'Brien; Harvey B. Jacobson

[57] ABSTRACT

A cotton cleaning attachment for a cotton scraper has a separator section mountable at a discharge end of a conventional scraper so as to receive scrap cotton, dirt and debris downwardly under the force of gravity from the discharge end of the scraper and separating the dirt and debris from the cotton. A transfer section, also mountable on the scraper and disposed downstream of the separator section, removes the cleaned cotton from the separator section, and causes the cotton to be fed to a subsequent stage of handling for further processing.

1 Claim, 4 Drawing Figures

COTTON CLEANING ATTACHMENT FOR COTTON SCRAPER

BACKGROUND OF THE INVENTION

1. Field of the Invention

This invention relates generally to cotton cleaning devices, and particularly to a cotton cleaning machine mountable directly on a cotton gleaner or scraper for separating dirt and debris from scrap cotton gathered by the scraper.

2. Description of the Prior Art

Devices generally referred to as cotton gleaners or cotton scrapers are commonly employed to traverse ground between cotton plants in order to recover cotton from a field after normal picking procedures have been completed. Such a gleaner or scraper is disclosed in U.S. Pat. No. 2,670,584, issued Mar. 2, 1954 to W. E. Rood, Jr. et al. Basically, these cotton scrapers employ an endless belt conveyor which engages cotton on the ground as the belt passes over a lower pulley on which the belt is mounted, and carries the gathered cotton upwardly along the lower run of the belt. While the cotton thus gathered can be merely deposited in a bin adjacent the upper end of the run of the belt, generally a further arrangement is provided for taking the gathered cotton from the endless belt and transmitting the cotton to a further point for ultimate discharge from the scraper. This is accomplished in cotton scrapers made under U.S. Pat. No. 2,670,584 in several manners, with a model manufactured in approximately 1960 or 1961 employing a drag chain device to achieve such further conveyance. Models manufactured immediately after the drag chain model use additional series of belts, with perhaps three belts being employed in all, and the intake end of each subsequent, or downstream, belt being disposed beneath the discharge, or upper end, of the previous, or upstream, belt from which the particular belt receives the cotton. In this manner, each belt after the first, or gathering, belt carries the gathered cotton on the upper run thereof, instead of the lower run as in the case of the initial belt.

Around 1964 or 1965, a basket was attached to the then current model of these cotton scrapers for catching the cotton as it is discharged.

A difficulty encountered with the continued use of older models of the cotton scraper, and particularly those made under U.S. Pat. No. 2,670,584 during the years 1960 to 1965, is that current EPA requirements placed on the ginning of cotton have made it economically necessary that the cotton gathered by a cotton scraper be cleaned prior to insertion into the gin in order to reduce ginning costs and increase the growers net yield of cotton per acre, while complying with the increasingly stringent requirements imposed on ginning operations by the Federal Government.

It should also be mentioned that although in theory the cotton scrapers as discussed above will operate with only a single endless belt at each stage of the scraper, from gathering to discharge, in practice it has been found that a plurality of belts disposed in parallel advantageously form each stage of such scrapers. These parallel belts are spaced slightly from one another so as to form gaps between them.

Cotton is conventionally cleaned by the use of a sawtooth drum used in combination with a doffer which removes the clean cotton from the drum. Examples of such cleaners can be found in U.S. Pat. No. 3,528,138, issued Sept. 15, 1970 to R. L. Elder; U.S. Pat. No. 3,382,544, issued May 14, 1968 to F. A. Moore; and U.S. Pat. No. 3,150,417, issued Sept. 29, 1964 to H. C. Word. These known cleaners, however, are specifically intended for use on the discharge of a conventional cotton-picker, and are not suitable for use with a cotton scraper. Further, the devices set forth in the aforementioned prior patents rely on fluid pressure to feed cotton into them, which pressure is not available on a cotton scraper, and which pressure in any event tends to create uneven feed into the device, and generally make inefficient the operation of the cleaner.

SUMMARY OF THE INVENTION

It is an object of the present invention to provide an attachment for an existing cotton scrapers which will permit cotton recovered by a scraper to be thoroughly cleaned prior to the cotton being fed to a cotton gin.

It is another object of the present invention to provide an attachment readily adaptable for use with several different models of existing cotton scrapers.

It is yet another object of the present invention to provide a cotton cleaning device capable of receiving cotton, dirt and debris or trash, under the fall of gravity, and without compaction of the cotton caused by the pressure of a fluid current feed of the cotton.

These and other objects are achieved according to the present invention by providing a cotton cleaning attachment having: a separator section mountable on a scraper at the discharge end of the scraper for receiving scrap cotton, dirt and debris or trash downwardly under the force of gravity from the scraper, and separating the dirt and trash from the cotton so as to clean the latter; and a transfer section also mountable on the scraper and arranged adjacent the separator section for removing clean cotton from the separator section and feeding the cotton as appropriate for further processing of the recovered and cleaned material.

The separator section preferably includes a drum rotatably mounted on the scraper, and provided with an outer circumferential surface having sawteeth aranged thereon for grasping the scrap cotton while permitting the dirt and trash to fall away from the cotton. A cage is arranged extending beneath the drum from adjacent the discharge end of the scraper for facilitating in retention of cotton on the drum while permitting the dirt and debris to fall away from the drum. The cage advantageously includes a plurality of spaced, substantially parallel rods arranged so as to curve around the adjacent lower periphery of the drum and in spaced relationship therefrom.

The cage further includes a pipe mounted on the scraper and disposed between an adjacent end one of the rods and the discharge end of the scraper. This pipe has a diameter larger than the diameter of the rods, and acts as a guide for directing the cotton, dirt and trash dischargd from the scraper into the space between the outer circumference or periphery of the sawtooth drum and the rods which form the combing portion of the cage.

The transfer section includes a fan rotatably mounted adjacent the drum, and also adjacent end one of the rods so as to be spaced from the discharge end of the scraper, and from the pipe associated with the cage. This fan acts as a doffer for removing cotton from the sawteeth of the drum, with the latter being disposed between the fan and the pipe portion of the cage.

A housing is mounted on the scraper so as to receive the fan, with the housing including a substantially horizontal surface arranged above the fan for diverting the cotton downwardly toward a blower carrying the cleaned cotton to a conventional storage bin, and the like.

These, together with other objects and advantages which will become subsequently apparent, reside in the details of construction and operation as more fully hereinafter described and claimed, reference being had to the accompanying drawings formimg a part hereof, wherein like numerals refer to like parts throughout.

DESCRIPTION OF THE PREFERRED EMBODIMENTS

Figure 1:
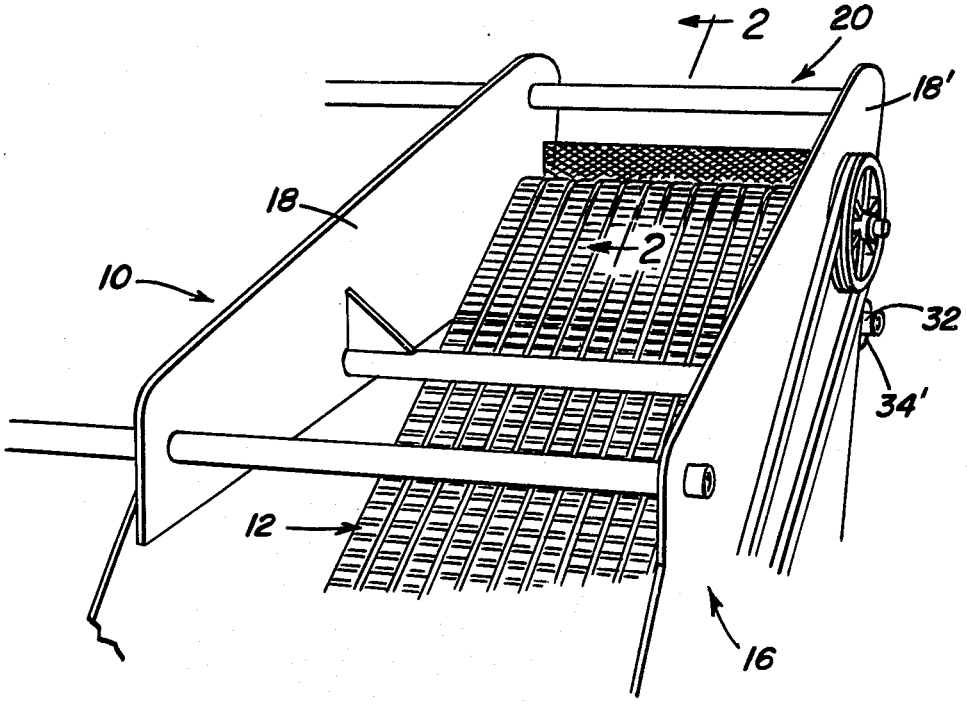
FIG. 1 is a fragmentary, schematic, perspective view showing a cotton scraper provided with a cleaning attachment according to the present invention.
Figure 3:
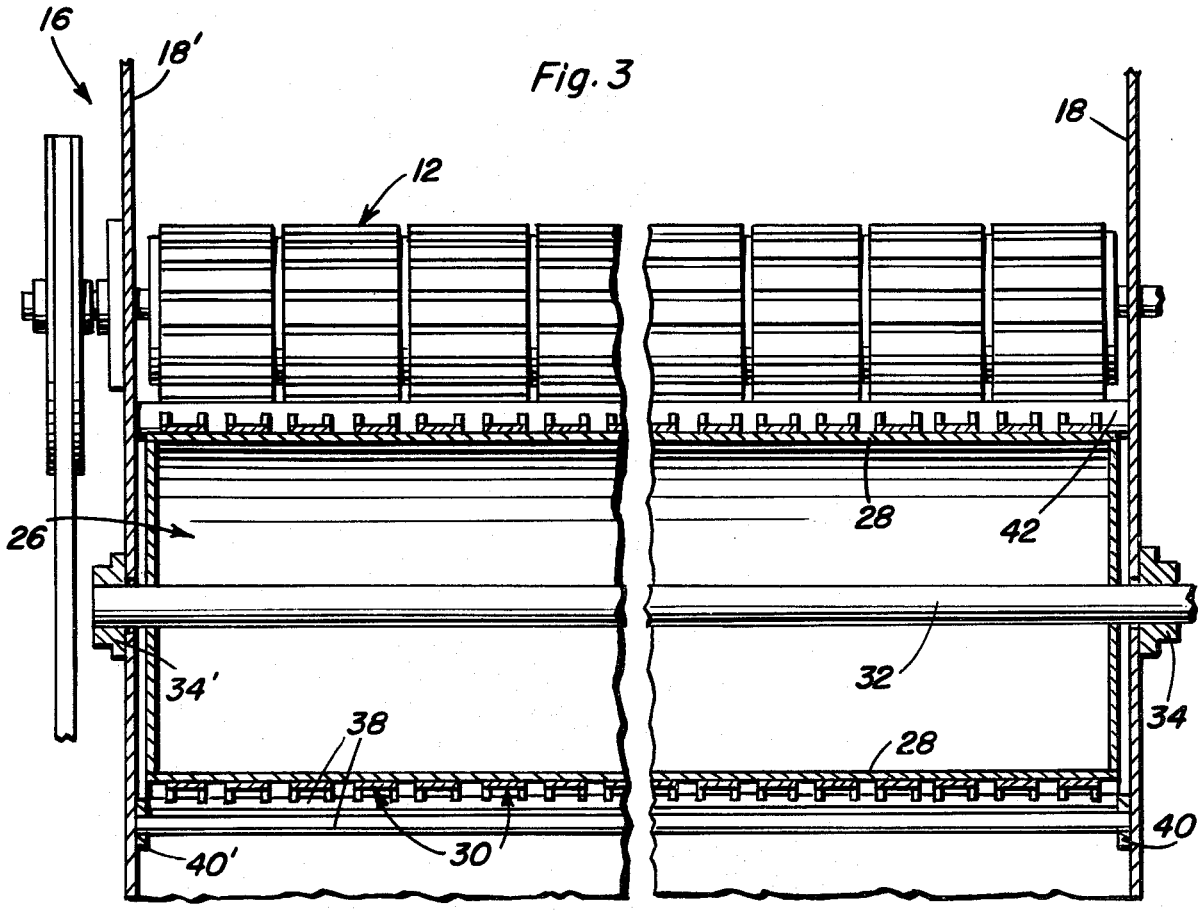
FIG. 3 is a fragmentary, sectional view taken generally along the line 3—3 of FIG. 2.
Figure 2:
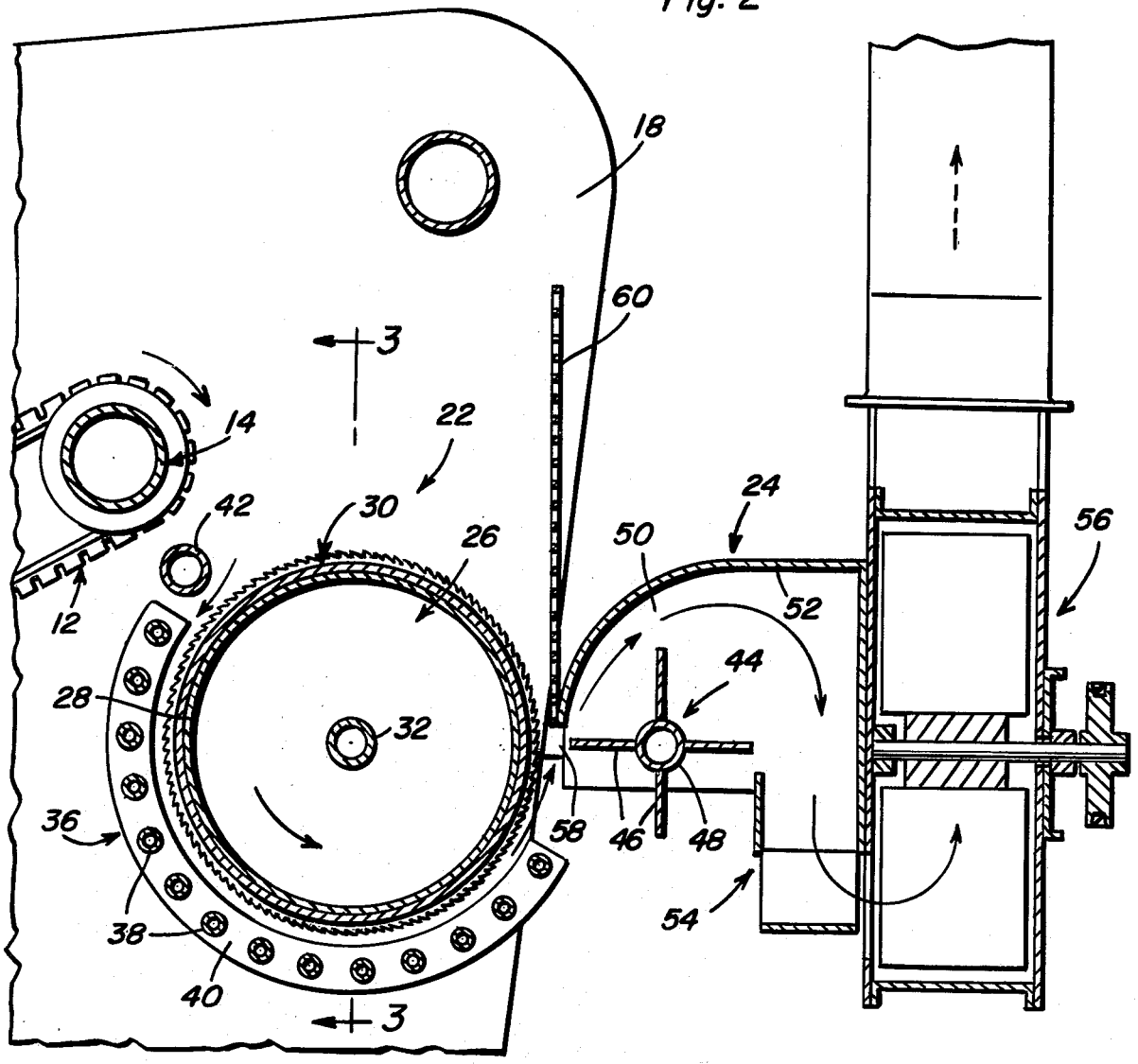
FIG. 2 is an enlarged, fragmentary, section view taken generally along the line 2—2 of FIG. 1.
Figure 4:
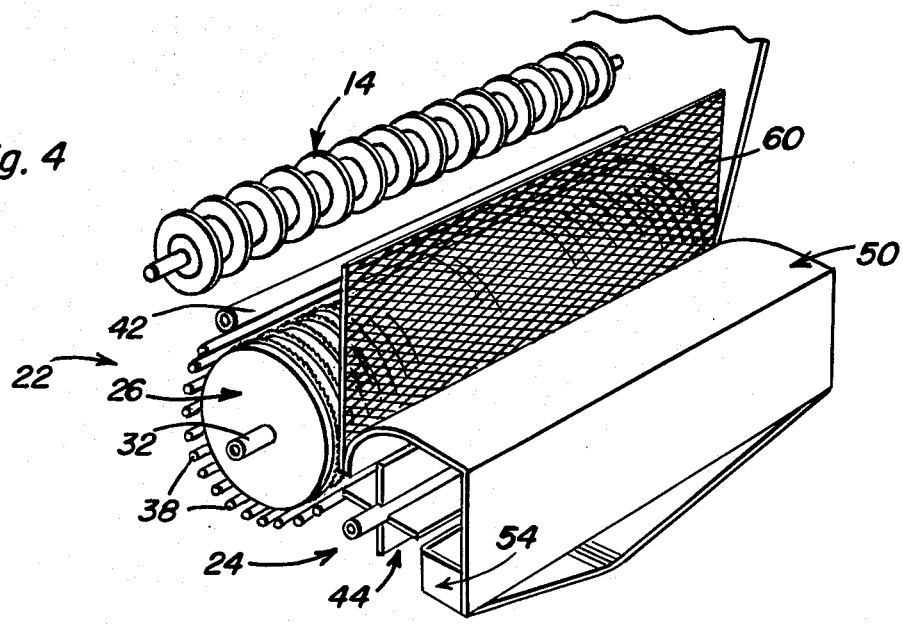
FIG. 4 is a fragmentary, schematic, perspective view showing the principal parts of a cleaning attachment according to the present invention together with the head pulley of an associated scraper.

Referring now more particularly to the Figures of the drawings, a cotton scraper 10 of conventional construction is shown as having a belt 12 at the uppermost portion thereof, which belt 12 includes a plurality of spaced, substantially parallel strands disposed about a head pulley 14 provided with a plurality of flanges which cause the belts to track with a predetermined spacing. Head pulley 14 is rotatably mounted on a frame 16 including a pair of substantially parallel, spaced sidewalls 18 and 18'. This construction as so far discussed of scraper 10 is conventional, and forms the upper, discharge portion or end of a cotton gleaner or scraper operating on the principle as disclosed in U.S. Pat. No. 2,670,584, issued Mar. 2, 1954 to W. E. Rood, Jr. et al. Further, while cotton scraper 10 is shown as terminating in a belt 12 disposed on a head pulley 14, it is to be understood that even those models of such cotton scrapers that employ drag chains (not shown) and the like can be employed with an attachment 20 according to the present invention. This attachment 20 is mounted on frame 16 of scraper 10 adjacent head pulley 14, and includes a separator assembly 22 which receives scrap cotton, dirt and debris or trash downwardly under the force of gravity from belt 12 and separates the dirt and trash from the cotton so as to clean the cotton, and a transfer assembly 24 shown mounted on frame 16 as by attachment to sidewalls 18 and 18', and disposed adjacent the separator assembly 22 for removing cotton from the assembly 22 and feeding same toward a storage bin (not shown) which can be disposed above the scraper 10 and supported by frame 16 thereof.

Separator assembly 22 includes a drum 26 rotatably mounted on frame 16 of scraper 10, and having an outer circumferential surface formed by a cylindrical wall 28 on which a plurality of sawteeth 30 are provided, which sawteeth 30 are arranged for grasping the scrap cotton fed to drum 26. The latter is journaled on sidewalls 18 and 18' as by shaft 32 disposed in bearings 34 and 34'. Rotation of shaft 32, and therefore drum 26, can be effected in a suitable manner, not shown, such as by connecting shaft 32 to the drive system of scraper 10.

Separator assembly 22 further includes a cage 36 arranged extending beneath drum 26 from adjacent the discharge end of scraper 10 substantially 180° from a point say 30° above a horizontal center line through shaft 32. This cage 36 acts to retain cotton (not shown) on the sawteeth 30 of drum 26, and includes a plurality of spaced, substantially parallel rods 38 curved around wall 28 of drum 26 and in spaced relation therefrom so as to permit the cotton to be retained by sawteeth 30. The rods 38, which function in the manner of a comb to permit dislodgment of dirt and trash from the cotton, are anchored on sidewalls 18 and 18' in a suitable manner, such as by the use of the illustrated perforated curved rails 40 and 40' attached to the inner surface of the associated walls 18 and 18'.

Cage 36 further includes a pipe 42 mounted on sidewalls 18, 18' and disposed extending between same so as to be adjacent an end one of the rods 38 and between such one of the rods 38 and head pulley 14. This pipe 42 has a diameter larger than a diameter of rods 38, and is arranged for guiding the cotton, dirt and trash from belt 12 onto drum 26 so that the cotton will pass between drum 26 and cage 36.

Transfer assembly 24 includes a fan 44 rotatably mounted adjacent drum 26 and the other of the end ones of the rods 38, that being the ones spaced furthest from head pulley 14, for removing cotton from sawteeth 30 of drum 26. The latter is disposed between fan 44, which functions as a doffer, and pipe 42 of cage 36.

Fan 44 includes a plurality of blades, with four perpendicularly extending blades being shown, which blades are affixed to a shaft 48 journaled in the sidewalls of a housing 50. This housing 50 is mounted on scraper 10 and includes a substantially horizontal surface 52 arranged above fan 44 for diverting the cotton downwardly through a chute 54 and into a blower 56 which can carry the cleaned cotton in a conventional manner upwardly to a holding bin (not shown) or similar shown mounted overhead of the scraper 10. Housing 50 is itself attached to frame 16 of scraper 10 as by the cantilever mounted brackets 58 and 58' attached to respective sidewalls 18 and 18'.

A screen 60, or similar dividing wall structure, is advantageously disposed extending from the portion of housing 50 closest to wall 28 of drum 46 for cooperating with fan 44 during removal of cotton from drum 26, and also for preventing any cotton not removed from drum 26 by fan 44 from being thrown away from separator assembly 22.

In operation, attachment 20 receives cotton, dirt and trash from belt 12 over head pulley 14, with the pipe 42 directing the material against the wall 28 of drum 26. The cotton will be grasped by sawteeth 30 while the dirt and trash will be knocked from the cotton by the combing action of cage 36, and permitted to fall through the gaps in cage 36 formed by the spacing between the rods 38. The now clean cotton will be brought around to fan 44 which acts to doff the cotton from sawteeth 30, and simultaneously create an air flow current due to rotation of blades 46 which causes the cotton to be directed downwardly due to the presence of wall 52, and to pass downwardly through chute 54 and into blower 56.

As can be readily understood from the above description and from the drawings, a cotton cleaning attachment according to the present invention permits existing cotton scrapers to be updated and to remain competitive with newer scrapers. Further, a cotton cleaner construction according to the present invention can be employed with newly constructed cotton scrapers as an integral part thereof so as to add an efficient cleaning capability to the scraper.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a cotton scraper including a conveyor arranged for discharging cotton, dirt and trash at an elevated discharge end of the conveyor, and a frame supporting the conveyor, a cotton cleaner, comprising, in combination:

(a) separator means mounted on the frame of the scraper at the discharge end of the conveyor for receiving cotton, dirt and trash downwardly under the force of gravity from the conveyor and separating the dirt and trash from the cotton and cleaning the latter, the separator means including a drum rotatably mounted on the scraper beneath the discharge end thereof, and having an outer circumferential surface provided with sawteeth arranged for grasping the cotton, the separator means further including a cage arranged beneath the drum at least half way around the circumferential surface of the drum from adjacent the discharge end of the scraper for retaining cotton on the drum while permitting dirt and debris to fall away from the drum, the cage including a plurality of spaced, substantially parallel rods curved around the drum in conformance with the outer circumferential surface thereof, but spaced from the outer circumferential surface a distance permitting the rods to form a comb facilitating cleaning of the cotton; and (b) transfer means mounted on the frame of the scraper adjacent the separator means for removing cleaned cotton from the separator means, the latter being arranged between the conveyor and the transfer means, the cage further including a pipe mounted on the scraper and disposed between an adjacent end one of the rods and the discharge end of the scraper, the pipe having a diameter larger than a diameter of the rods for facilitating guidance of the cotton, dirt and debris against the outer circumferential surface of the drum, the transfer means including a fan means rotatably mounted adjacent the separator means, and spaced from the discharge end of the scraper, for removing upwardly moving cotton from the separator means at a point the level of the pipe, the latter being disposed between the fan means and the discharge end of the scraper.

* * * * *